United States Patent [19]

Acevedo

[11] 4,210,185

[45] Jul. 1, 1980

[54] TOOL HANDLE ASSEMBLY WITH FREELY-REVERSIBLE SOCKET MEMBER

[76] Inventor: Ignacio Acevedo, 4066 Fenwick Rd., Columbus, Ohio 43220

[21] Appl. No.: 962,906

[22] Filed: Nov. 22, 1978

[51] Int. Cl.² ..... B25B 15/00

[52] U.S. Cl. ..... 145/76; 145/50 R; 145/61 R

[58] Field of Search ..... 145/61 R, 61 L, 61 EA, 145/76, 70, 77, 50 R

[56] References Cited

U.S. PATENT DOCUMENTS

| | | | |
|---|---|---|---|
| 2,418,638 | 4/1947 | Hoover | 145/50 R |
| 2,792,094 | 5/1957 | Balwin | 145/50 R |
| 2,950,746 | 8/1960 | Towne | 145/77 |
| 4,143,693 | 3/1979 | Acevedo | 145/76 |

*Primary Examiner*—Othell M. Simpson
*Assistant Examiner*—Roscoe V. Parker, Jr.
*Attorney, Agent, or Firm*—William V. Miller

[57] ABSTRACT

A tool handle assembly including a hand grip to be engaged by one hand, having a freely-reversible socket member carried thereby which has a socket for non-rotatably and removably receiving a tool adapter, the tool adapter having a socket for non-rotatably and removably receiving a tool element, and a finger grip or spinner for engaging by the fingers of the other hand, non-rotatably fixed on the adapter. The socket member is mounted in the hand grip by means of a one-way driving spring clutch. All the parts of the assembly are so arranged that the spinner does not contact the adjacent end of the hand grip so that these members are always free to rotate relatively, to permit free reversal of the hand grip.

9 Claims, 6 Drawing Figures

TOOL HANDLE ASSEMBLY WITH FREELY-REVERSIBLE SOCKET MEMBER

BACKGROUND AND PURPOSE OF THE INVENTION

This invention relates to a tool handle assembly for receiving and applying torque to a tool element of the general type disclosed in my copending application Ser. No. 862,573, filed Dec. 20, 1977, now U.S. Pat. No. 4,143,693, and in U.S. Pat. No. 2,950,746 cited therein. However, the handle assembly of the present invention includes a tool adapter between a freely-reversible socket member carried by the hand grip, and the tool element, the adapter carrying a spinner collar that is non-rotatably mounted thereon and serving to hold the tool element on the work or to spin it. The spinner collar is held or gripped with the fingers of one hand while the grip handle is gripped with the other hand to drive the tool element and the parts of the assembly are so disposed that the spinner and hand grip are always free to rotate relatively in the reversing action of the hand grip. Holding of the tool assembly during use is greatly facilitated through the use of the hand grip and spinner collar as compared to the handle assemblies mentioned above.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
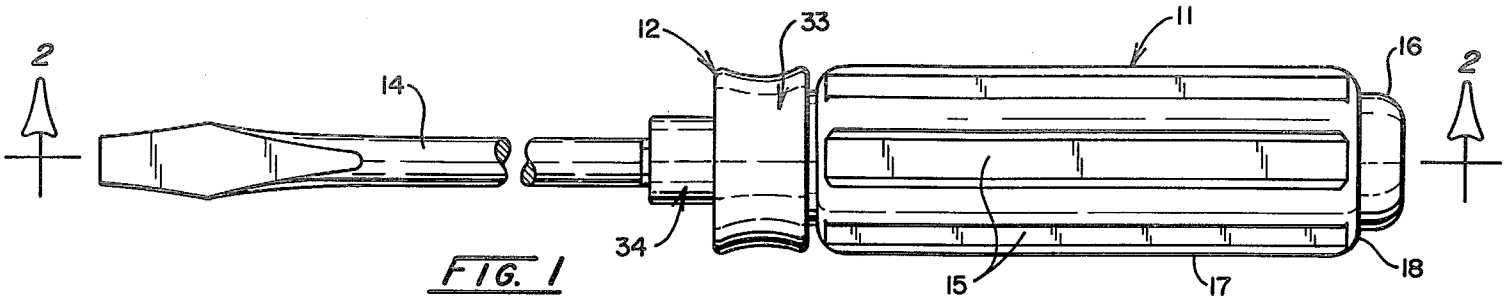
FIG. 1 is a side elevational view of a handle assembly embodying this invention shown carrying a tool element of the screw driver type.

With detailed reference to the drawings, the handle assembly of this invention is illustrated as comprising two separate units, namely, the grip handle assembly 11, and the tool adapter and spinner assembly 12. The tool adapter and spinner assembly 12 is shown in FIGS. 1 & 2 as receiving the shank of a screwdriver 14 but it is to be understood that various tools may be carried by the adapter. The assemblies 11 & 12 are shown separated in FIG. 1A.

The hand grip of the assembly 11 is of special formation and is preferably molded from a suitable plastic. It is mainly of elongated cylindrical or tubular shape so it can be readily gripped by one hand, having angularly spaced, longitudinaly extending ribs 15 around its peripheral surface to facilitate this gripping. These ribs terminate just short of the opposed ends which are of special formation so as to selectively receive the assembly 12. Thus, a reduced convex extension 16 is formed on each end and merges with the main body 17 of the hand grip at a rounded shoulder 18.

Each end of the hand grip body 17 has mounted therein a one-way clutch type socket and driving assembly for driving the assembly 12 and, thereby, the tool element 14. This clutch assembly consists of the driven adapter-receiving socket member 21, the driving member 22, and the clutch spring 23, which are all axially aligned in a receiving socket 19 formed in the end of the body 17 and opening axially outwardly. The member 22 is non-rotatably fixed in position within the inner end of hand grip socket 19 by its inner shank portion 24 which is of angular cross-section and which fits within an inner reduced socket portion **19*a* of complemental cross-section at the closed inner end of the hand grip socket 19, and the fit can be a molded or pressed fit. A peripheral flange 25*a* is formed on the driving member 22, just outwardly of portion 24, and beyond this flange is a shaft portion 25. The driven socket member 21 is rotatably mounted in the hand grip socket 19, at its outer open end, and has an inwardly extending shaft portion 26 of the same diameter and in axial alignment with the shaft portion 25 of the driving member 22. The adjacent flat ends of these two shaft portions abut at 27 and are held in contact by a retainer ring 28 which is pressed-fit into the hand grip socket 19, at its outer open end, around the socket portion 30 which is free to rotate therein. The contacting shaft ends at 27** are free to rotate relatively.

The outer end of the driven socket member 21 has an axially outwardly-opening socket 29, in the socket portion 30, formed therein which is of angular form for receiving a complementally shaped shank on the adapter assembly 12. It will be noted that the socket portion 30 is of the same diameter as the flange **25*a* and these portions serve as retaining flanges or shoulders between which the clutch spring 23 is disposed and is tightly coiled around the axially aligned and meeting shaft portions 25 and 26 of the respective members 21 and 22. It is also in frictional engagement with the wall of socket 19. This spring 23 is preferably of wire of square or angular cross-section so it will increase its frictional engagement with the annular surfaces of shaft portions 25 and 16** and the socket wall.

The spring 23 will serve as a one-way clutch so that when the hand grip body 17 of assembly 11 is turned in one direction to correspondingly turn the driving member 22, the spring will wind on and tighten on the two shaft portions 25 and 26, to correspondingly drive the socket member 21 in one direction. However, when the hand grip body 17 is rotated in a reverse direction, the spring 23 will be unwound to release shaft portions 25 and 26 and thereby permit the hand grip body to freely rotate relative to the socket member 21.

A driver unit consisting of the three parts 21,22, 23, is preferably mounted in each end of the hand grip body 17 for receiving the tool adapter assembly 12 selectively at either end. The only difference in the units at opposed ends will be that the springs 23 of the opposite end units will be properly wound in reverse directions. Therefore, the tool element, such as screwdriver 14, will be mounted at one end for driving the screw and at the other end for removal of the screw. In each case, the hand grip body 17 will be turned in the proper direction to perform the work but will be freely rotatable in the opposite direction.

Figure 1A:
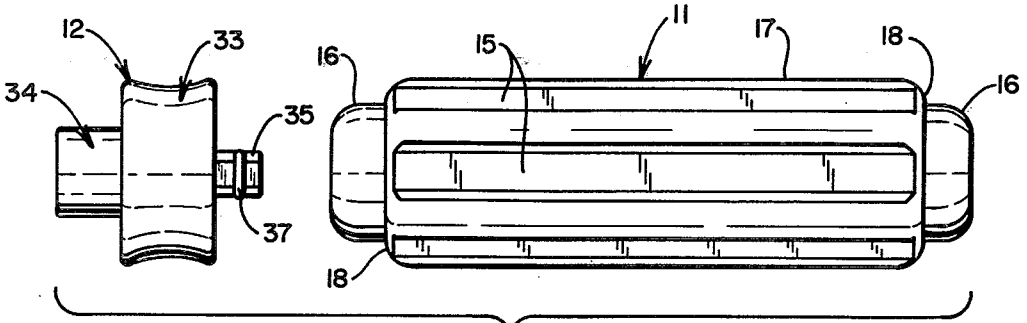
FIG. 1A is a side elevational view showing the two assemblies of this invention separated.
Figure 2:
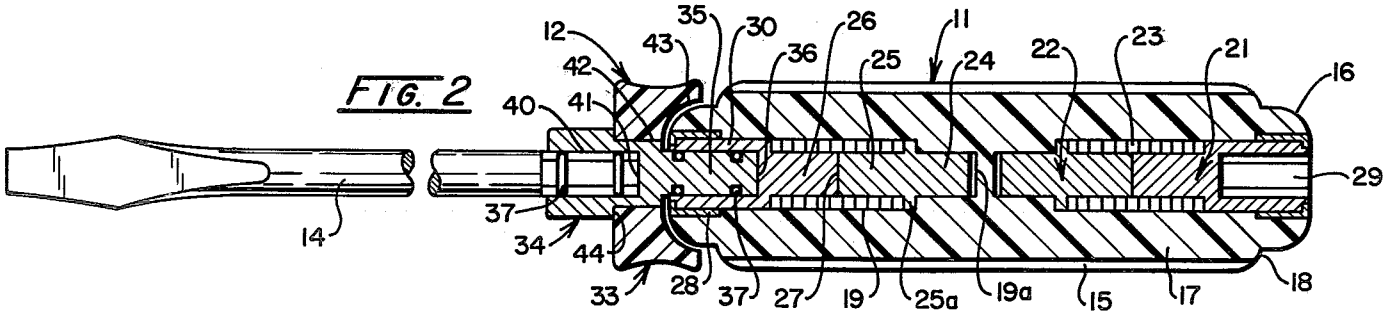
FIG. 2 is an axial sectional view taken along line 2—2 of FIG. 1.
Figure 3:
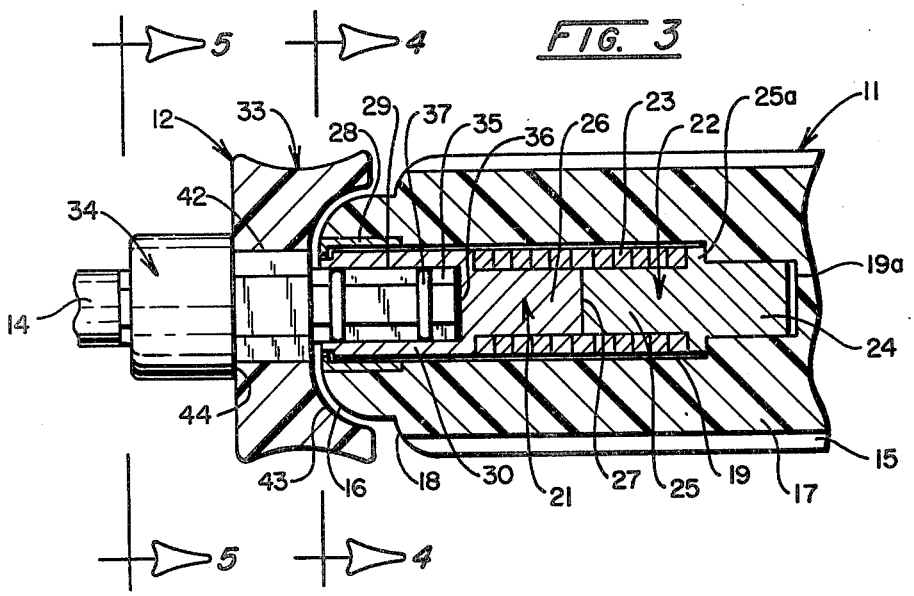
FIG. 3 is an enlarged partial axial sectional view taken through the grip handle and cooperating spinner.
Figure 4:
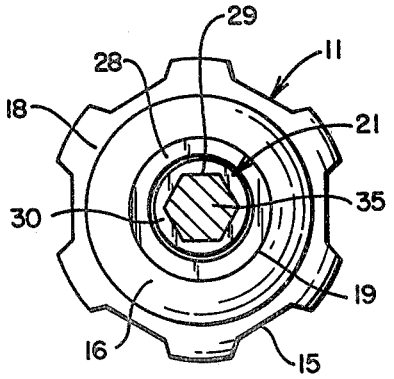
FIG. 4 is a transverse schematic sectional view taken along line 4—4 of FIG. 3.
Figure 5:
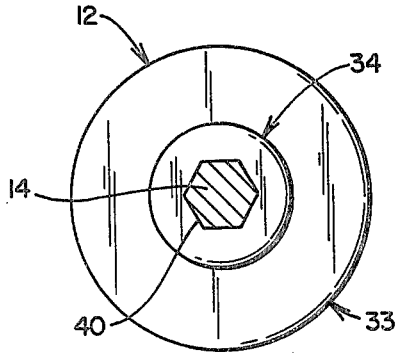
FIG. 5 is a transverse sectional view taken along line 5—5 of FIG. 3.

The assembly 12 is shown removed from the assembly 11 in FIG. 1A. The assembly 12 includes a finger-grip collar or spinner 33 and a tool adapter member 34. The member 34 has an inner reduced shank portion 35 which is of complemental angular form to the socket portion 30 of member 21 and into which it may be slipped, as indicated in FIGS. 2 and 3. When so inserted, the flat inner end of shank 35 will contact at 36 with the flat closed inner end of the socket 29 in member 21. O-rings 37 may be provided on shank 35 to provide friction to normally retain the shank in the socket. The outer part of member 34 is provided with an angular socket 40 for receiving the complemental angular shank of the tool element 14 which will have its flat inner end in contact with the flat inner closed end 41 of the socket 40. Here also O-rings 37 may be provided to increase friction to maintain the shank in the socket. The outer portion of member 34 is of enlarged angular form at 42 where a central angular opening in the finger-grip spinner collar 33 is pressed-fit thereon. This collar is of ring form and is preferably made of a suitable plastic. Its annular periphery is preferably concavely grooved to facilitate gripping with the fingers. At its axially-inner face, it is of concave form to provide a concave pocket 43 for selectively receiving either of the convex end protuberances 16 on the body 17 of the hand grip assembly 11. Outwardly of portion 42, the member 34 is enlarged still more to provide a stop shoulder 44 axially outwardly of collar 33. It will be noted that collar 33 and hand grip body 17 are of substantially the same diameter.

With the assemblies 11 and 12 joined as indicated in FIGS. 1,2 and 3 and the tool element 14 inserted, the tool can be held on the work, such as a screw, by the fingers of one hand engaging with the concavely grooved surface of spinner collar 33. The other hand can grip the body 17 of the hand grip assembly 11 to drive the screw, free reverse rotation of the hand grip being permitted, because of the arrangement of spring clutch 23. During this work period, the tool 14 can be held on the screw by the fingers of one hand engaging collar 33. Axial pressure on the work will be accomplished by pushing inwardly on the hand grip body 17 and it will be noted that this pressure is applied (FIG. 2) by metal-to-metal contact, through the cooperating axially-aligned metal members 22,21, and 34 at the flat contacting ends of these respective members located at 27, 36, and 41. The convex end protuberance 16 of the hand grip body 17 will be in the concave pocket 43 of the collar 33 but the adjacent surfaces will not contact, so that the hand grip body 17 and collar 33 can be rotated relatively to permit free reversal of the hand grip while the tool is held on the work by collar 33. There will always be a space between these surfaces to permit this relative rotation.

When removing the screw, the assembly 12 will be removed from the hand grip assembly 11 and the shank 35 thereof will be inserted in the socket member 21 at the opposite end. Then, the screw can be loosened readily and when loosened sufficiently, the sinner collar 33 can be turned quickly with the fingers to remove the screw, while the tool is held in place by means of hand grip body 17. The identical convex protruding ends 16 of the hand grip body will selectively fit in the concave outer face pocket 43 of the collar 33 but will not contact therewith so that these members will always be relatively rotatable.

With this arrangement, the driver hand grip assembly 11 can functo drive the tool in a working direction by turning it properly but will permit free rotation in the opposite direction due to the spring clutch arrangement. The hand grip assembly will readily receive the finger grip collar and tool adapter assembly at either end and still permit relative rotation of these assemblies to permit full reversal of the hand grip. This arrangement will greatly facilitate the holding and use of the tool, since the finger grip spinner collar can be engaged to hold the tool in place during the application of torque thereto by gripping the hand grip body with the other hand or, at times, to spin the tool.

Having thus described this invention what is claimed is:

1. A handle assembly for receiving and applying torque to a tool element comprising a hand-grip assembly and a tool adapter assembly; said hand grip assembly and tool adapter assembly being mounted for rotation relative to one another; said hand grip assembly comprising a hand grip body, socket member rotatably mounted in said body and having an outwardly-opening adapter-receiving socket, a spring clutch mounted in said hand grip body in cooperation with said socket member to prevent relative rotation in one direction but permit relative rotation in a reverse direction; said tool adapter assembly having a finger-grip collar non-rotatably mounted thereon and having an inwardly extending shank portion adapted to removably fit in said adapter-receiving socket and an outwardly extending socket portion with an outwardly-opening tool-receiving socket for receiving the shank of a tool element, said adapter shank contacting the adapter-receiving socket member to provide a space between said hand grip body and said collar to permit said relative rotation at all times.

2. A handle assembly according to claim 1 in which the socket member in the hand grip body and the tool adapter shank are axially aligned and have contacting adjacent ends, said hand grip body having an end which is adjacent to said collar but is spaced therefrom by contact of said contacting ends.

3. A handle assembly according to claim 2 in which the said end of the hand grip body is convex and the collar has an adjacent face with a concave pocket for receiving said end.

4. A handle assembly according to claim 3 in which the collar has a peripheral surface which is concavely grooved.

5. A handle assembly according to claim 3 or claim 4 in which both ends of the hand grip body are of the convex form, and an adapter-receiving socket member is mounted in each end.

6. A handle assembly according to claim 2 in which the adapter-receiving socket member in the hand grip body is driven by a driving member anchored in said body in a socket in the hand grip axially inwardly of said socket member, said members having axially-aligned shaft portions in said last-named socket and said spring clutch comprising a spring wound around said shaft portions and engaging the wall of the socket.

7. A handle assembly according to claim 6 in which the shaft portions have inner ends in relatively rotatable contact.

8. A handle assembly according to claim 2 in which each end of the hand grip body has a socket member rotatably mounted therein with a spring clutch which permits rotation of the socket member in a reverse direction relative to that at the other end.

9. A handle according to claim 6 in which the hand grip has an outwardly-opening socket at each end with the adapter-receiving socket member and driving member along with the cooperating spring mounted therein the springs in the sockets at the opposite ends being reversely wound.

* * * * *